United States Patent [19]

Fasano

[11] 4,156,569

[45] May 29, 1979

[54] APPARATUS FOR AUTOMATICALLY TREATING PIECES OF EXPOSED PHOTOSENSITIVE PAPER

[75] Inventor: Osvaldo Fasano, Turin, Italy

[73] Assignee: Morenar, S.A., Fribourg, Switzerland

[21] Appl. No.: 817,338

[22] Filed: Jul. 20, 1977

Related U.S. Application Data

[63] Continuation-in-part of Ser. No. 787,095, Apr. 13, 1977, Pat. No. 4,130,825.

[30] Foreign Application Priority Data

Apr. 13, 1976 [IT] Italy ..... 67859 A/76
Nov. 26, 1976 [IT] Italy ..... 69824 A/76

[51] Int. Cl.[2] ..... G03D 3/10

[52] U.S. Cl. ..... 354/322; 354/328; 354/338; 134/64 P

[58] Field of Search ..... 354/316, 319, 320, 321, 354/322, 328, 338, 339; 134/64 P, 64 R, 122 P, 122 R

[56] References Cited

U.S. PATENT DOCUMENTS

| | | | |
|---|---|---|---|
| 2,927,503 | 3/1960 | Zollinger | 354/339 |
| 3,712,206 | 1/1973 | Schmidt | 354/322 |
| 3,760,705 | 9/1973 | Miller | 354/322 |
| 3,769,897 | 11/1973 | Zwettler | 354/322 |
| 3,882,525 | 5/1975 | Zwettler | 354/316 |
| 4,032,943 | 6/1977 | Zwettler | 354/322 |

*Primary Examiner*—L. T. Hix
*Assistant Examiner*—Alan Mathews
*Attorney, Agent, or Firm*—Remy J. VanOphem

[57] ABSTRACT

Apparatus for automatically treating photosensitive paper after exposure in an automatic camera comprises four treatment tanks each having its own dipping mechanism, and three transfer mechanisms between the tanks. Each dipping mechanism and each transfer mechanism comprises a pair of grooves in which the paper can slide, and one or two motor-driven teeth to push the paper along the grooves. By use of separate dipping mechanisms and separate transfer mechanisms, only the paper travels from tank to tank, minimizing transfer of fluid from one tank to the next.

14 Claims, 9 Drawing Figures

APPARATUS FOR AUTOMATICALLY TREATING PIECES OF EXPOSED PHOTOSENSITIVE PAPER

CROSS-REFERENCE TO RELATED APPLICATIONS

This application is a continuation-in-part of U.S. application Ser. No. 787,095 filed Apr. 13, 1977, now U.S. Pat. No. 4,130,825, APPARATUS FOR AUTOMATICALLY TREATING PIECES OF EXPOSED PHOTOSENSITIVE PAPER.

BACKGROUND OF THE INVENTION

1. Field of the Invention

The present invention relates to apparatus for automatically treating pieces of exposed photosensitive paper particularly for automatic cameras of a type for obtaining standard size pictures for cards, identity cards and the like.

2. Description of Prior Art

Automatic cameras of the above mentioned type are known, in which a sheet or coupon of photosensitive paper, e.g. obtained by cutting a paper roll, is exposed in a conventional manner in a chamber and is then conveyed to a treatment system designed to successively dip the coupon into developing, fixing and possibly reversal, as well as washing baths, in an automatic way, thereby providing to the user a finished photograph delivered through an outlet slot.

The treatment system may have various configurations. In one of such systems, a chain having paper-retaining members such as teeth and the like successively conveys the coupon from one tank to another and in this case the path of the chain has loops which extend inside the tanks. According to another system, the coupon is conveyed to a basket carried by an arm designed to successively immerse the basket in suitable treatment tanks until completion of the developing, reversal and/or fixing and washing treatment has occurred.

In both such known treatment systems the dwelling or stay time of the coupon to be developed in the various successive baths are determined in a quite rigid way, in view of the requirement that more than one coupon should be treated in succession without waiting for termination of the treatment of the preceding coupon, and in practice such times are limited to values which are in integer-number ratios. In fact, e.g. with the chain system, immersion durations in each bath, bearing in mind that the chain must move uniformly and can carry different coupons to different sectors, are determined by the length of the immersed loops in each bath. It is then possible, while designing the machine, to establish the number of loops the chain has to follow in each bath, thereby obtaining times equal to 1, 2, 3, . . . times a basic time. Similarly, in the basket arm system one may obtain times 1, 2, 3 times a base time by arranging a plurality of adjacent tanks containing the same bath in a number proportional to the required dwelling time. Rigidity in determining the times results in the necessity for a machine user to use baths prepared in predetermined dilutions.

The above mentioned treatment systems also have the serious inconvenience of continuously transporting small amounts of liquid out of a bath by way of the conveying member of the coupon which is the chain in the first case, and the basket in the second case. The amount of liquid carried away from one bath and placed in the successive bath is relatively great, e.g. at least of the order of the amount absorbed by the coupon. Consequently, the above mentioned conveying systems cause considerable pollution in each bath owing to the liquid coming from a preceding bath, which results in premature deterioration of the baths. This then results in higher cost for removal of the baths and higher maintenance costs due to higher frequency at which the machine has to be attended for replacement or restoration of the baths. Such additional maintenance costs are particularly undesirable when, as often happens with this kind of automatic camera, the machines are located in positions far from each other on an urban area although they are administered by a single administrator.

SUMMARY OF THE INVENTION

According to the invention there is provided apparatus for automatically treating pieces of exposed photosensitive paper, comprising at least three tanks each of which is adapted to contain a respective treatment bath, at least three dipping mechanisms each associated with a respective one of the tanks, for dipping one at a time of said pieces of paper into the respective bath, each dipping mechanism including a respective slide guide having an inlet end and an outlet end and an intermediate zone arranged so that, in use, the inlet and outlet ends are external to the bath while the intermediate zone is immersed in the bath, the slide guide being adapted for the piece of paper to slide in the slide guide, each dipping mechanism also including a respective conveying mechanism including a respective travelling member adapted to engage the piece of paper in the respective slide guide and to move the piece of paper along the respective slide guide from the inlet end along the intermediate zone to the outlet end thereof and to automatically disengage from the piece of paper at the outlet end, at least two transfer mechanisms each arranged between a respective pair of said dipping mechanisms and each comprising a respective slide guide adapted for the piece of paper to slide therein and extending from the outlet end of the slide guide of one dipping mechanism of the said pair to the inlet end of the slide guide of the other dipping mechanism of the said pair, each transfer mechanism also comprising a respective conveying mechanism including a respective travelling member adapted to engage the piece of paper in the respective slide guide and to move the piece of paper along the slide guide, and control means adapted to stop each dipping mechanism for a period of time while the piece of paper is immersed in the respective bath.

DETAILED DESCRIPTION OF PREFERRED EMBODIMENT

Figure 1:
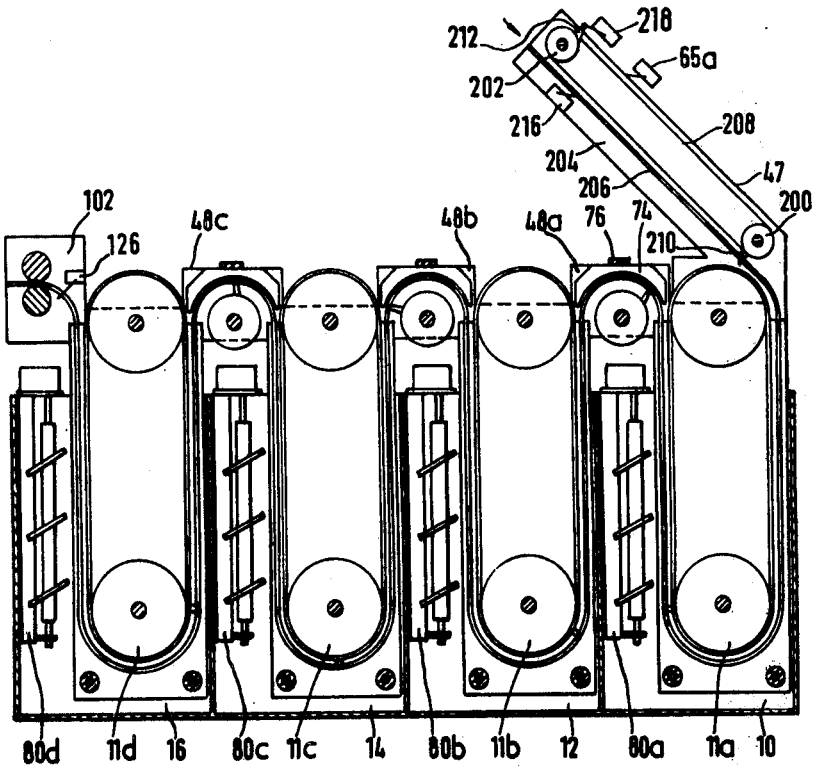
FIG. 1 is a longitudinal sectional view of a treatment apparatus according to the invention.

With reference to FIG. 1, a treatment apparatus for an automatic camera comprises a plurality of tanks, 10, 12, 14, 16 arranged successively adjacent to one another and each containing a different photographic treatment bath in which a piece or coupon of exposed photographic paper material must dwell or stay for an individually predetermined time. The tanks 10 to 16 are preferably prismatic in shape, rectangular or square in top view, and open upwards.

Figure 2:
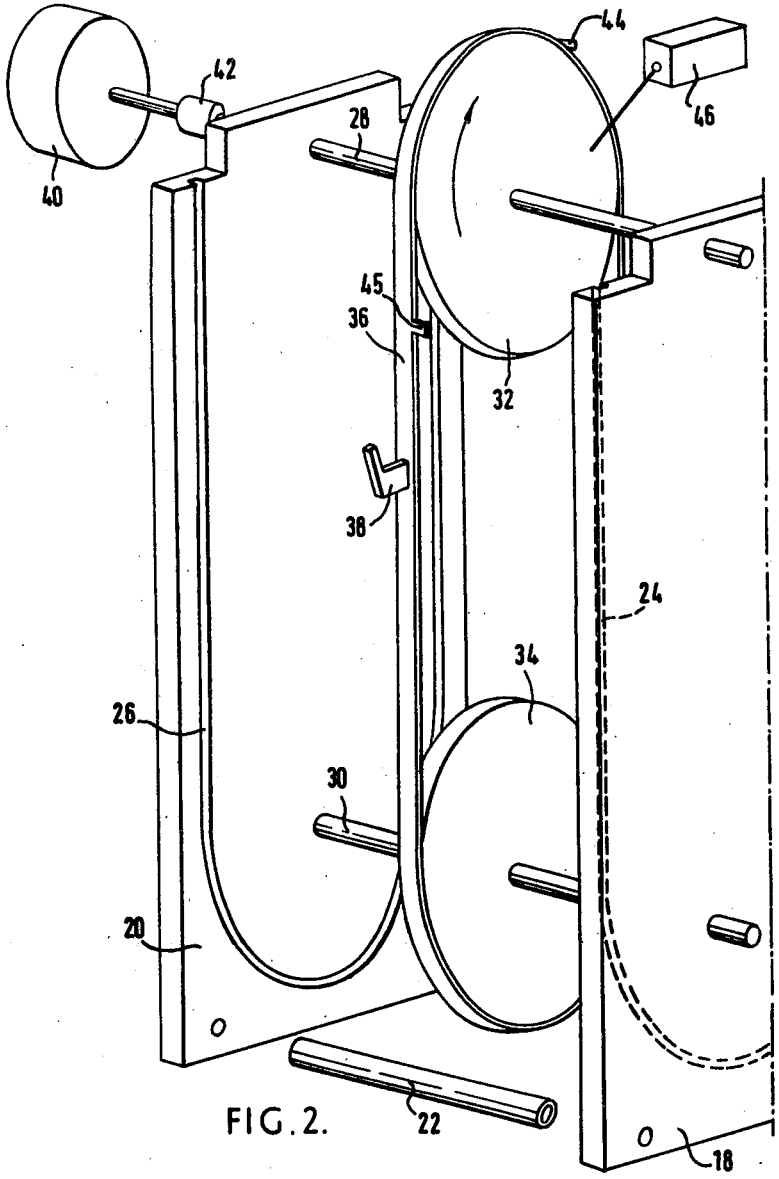
FIG. 2 is a diagrammatic perspective view of a dipping mechanism of the apparatus of FIG. 1.

With reference to FIGS. 1 and 2, a dipping mechanism 11*a*, 11*b*, 11*c*, 11*d*, respectively, is partly immersed in a respective tank 10, 12, 14, 16. FIG. 2 shows the dipping mechanism 11*a* which comprises two side walls 18, 20 connected to one another by means of spacers 22. In each of the inner faces of the side walls 18, 20 there are formed respective guide grooves 24, 26 each of which has two parallel vertical straight lengths and an intermediate semicircular length. The distance between the grooves in the two opposite side walls and their depth are such that the coupon 13 can be located therein at its lateral edges in sliding engagement with opposite grooves. Two pulleys 32, 34 mounted on respective shafts 28, 30 are rotatably supported between the side walls 18 and 20 and carry a belt 36. The disposition and the dimensions of the pulleys 32, 34 with the belt 36 are such that the belt follows a path substantially parallel to the grooves 24, 26 while keeping itself on the inner side of the loop.

The belt 36 bears a tooth 38 for carrying the coupon (as better described below), the tooth projecting from the belt 36 to a point where it touches an imaginary surface defined by the grooves 26, 24.

The pulley 32 is driven by an electric motor 40 by way of a safety coupling. Furthermore, the pulley 32 bears a control tooth 44 designed to actuate a microswitch 46 to indicate to external control circuits (described below) a determined position reached by the tooth 38, as will be described below.

With reference to FIG. 1, the numeral 47 indicates an introducer mechanism comprising two pulleys 200, 202 mounted for rotation between two opposite walls 204 each of which is formed with grooves 206 similar to the grooves 26 of the dipping mechanisms 11. A driving belt 208 is carried by the pulleys 200, 202, which is similar to the belts 36 of the dipping mechanisms, the belt 208 having two teeth 210, 212 for carrying the coupon which are fixed to the belt at diametrically opposed points thereof.

Figure 8:
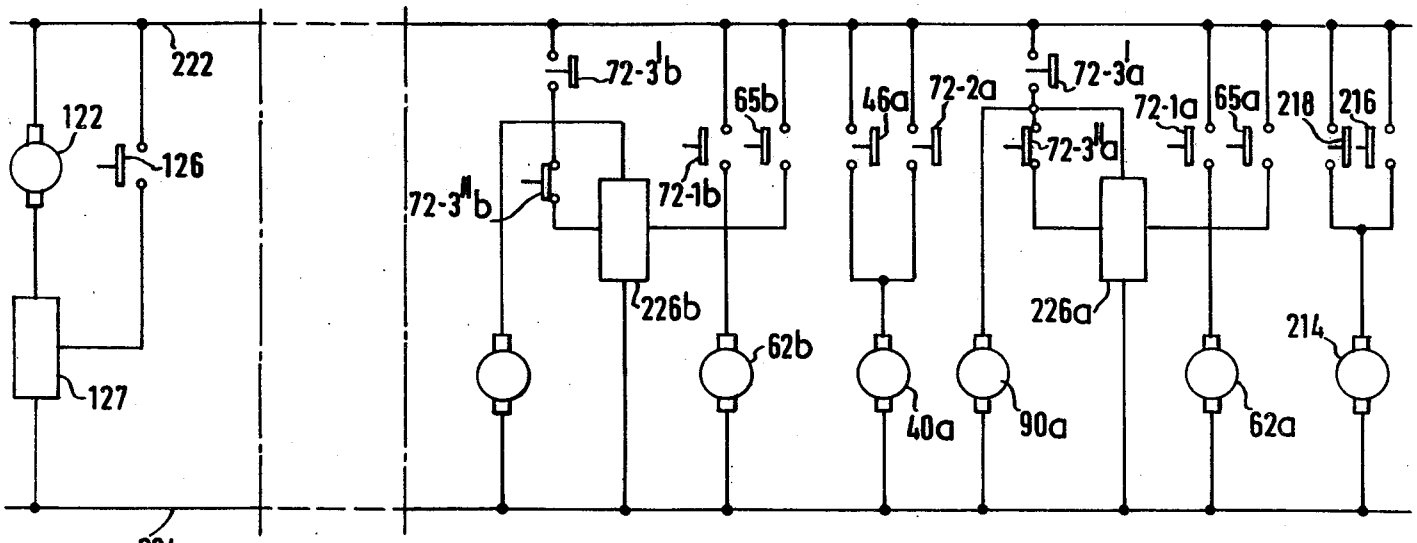
FIG. 8 is a complete circuit diagram of the entire apparatus.

The pulley 202 is driven by a synchronous motor not shown in FIG. 1 and generally indicated by 214 in FIG. 8.

The introducer mechanism 47 carries a first normally open microswitch 215 for detecting the coupon, a second normally closed self-holding microswitch 218, and a third normally open microswitch 65*a*. The microswitches are connected to electric control circuits described below.

The dipping mechanisms 11*b*, 11*c*, 11*d* are identical to the mechanism 11*a* described with reference to FIG. 2.

Figure 3:
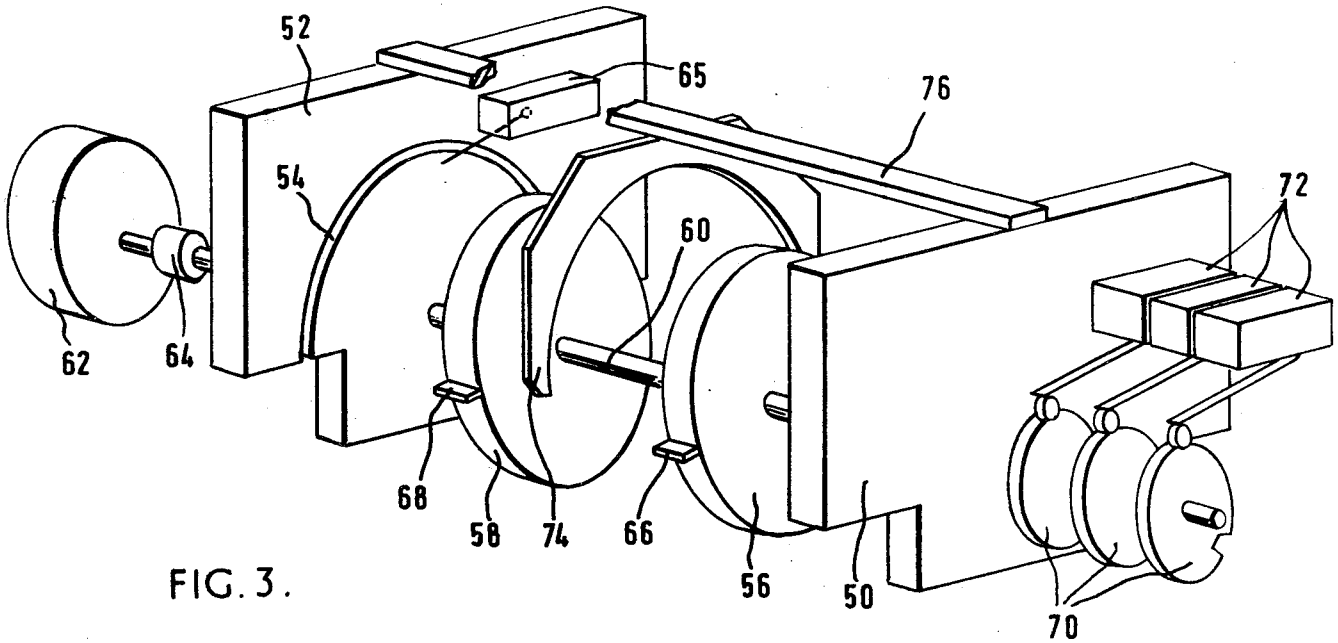
FIG. 3 is a diagrammatic perspective view of a transfer mechanism which is part of the apparatus of FIG. 1.

Between each pair of dipping mechanisms 11 of adjacent tanks, there is mounted a transfer mechanism 48*a*, 48*b* or 48*c* respectively designed to transfer the coupon from one dipping mechanism to another and then from a treatment bath to a successive one. With reference to FIG. 3, we shall now describe the transfer mechanism 48*a*.

The transfer mechanism 48*a* comprises two side walls 50, 52 which are rigidly connected to corresponding side walls of the two dipping mechanisms with which the transfer mechanism cooperates so as to have their inner faces at the same level as those of the dipping mechanisms. The inner faces of the side walls 50, 52 are formed with guide grooves 54 for the coupon, which grooves have a semicircular loop form and their ends adjoining the guide grooves in the contiguous dipping mechanisms so as to form a continuous guide.

Between the walls 50 and 52, two transfer wheels 56, 58 are co-axially and rigidly mounted on a shaft 60 which is coaxial with the semicircular grooves 54 and which is driven by an electric motor 62 by way of a coupling 64.

The transfer mechanism comprises a microswitch 65 adapted to be actuated by an incoming coupon to control electric control circuits described below.

The diameter of each of the wheels 56, 58 is slightly smaller than the diameter of the semicircles 54, and the wheels 56, 58 carry respective teeth 66, 68 which are mutually aligned and project from the wheels to a point where they interfere with an imaginary cylindrical surface defined by the grooves 54.

Outside of the side walls 50, 52, a plurality of cams 70 are keyed on the shaft 66 and cooperate with respective microswitches 72 to generate electrical signals indicating the positions reaches by the teeth 66, 68 while the shaft 60 rotates.

In an intermediate position between the wheels 56, 58, the transfer mechanism comprises an arch-like shoe or skid 74 against which the coupon can lie, the shoe having an inner diameter which is slightly greater than the semicircle defined by the grooves 54, and having a function which will be described below. The skid 74 is supported by a transverse member 76 carried by the side walls 50, 52.

The transfer mechanisms 48*b* and 48*c* are identical to the transfer mechanism 48*a*.

Figure 4:
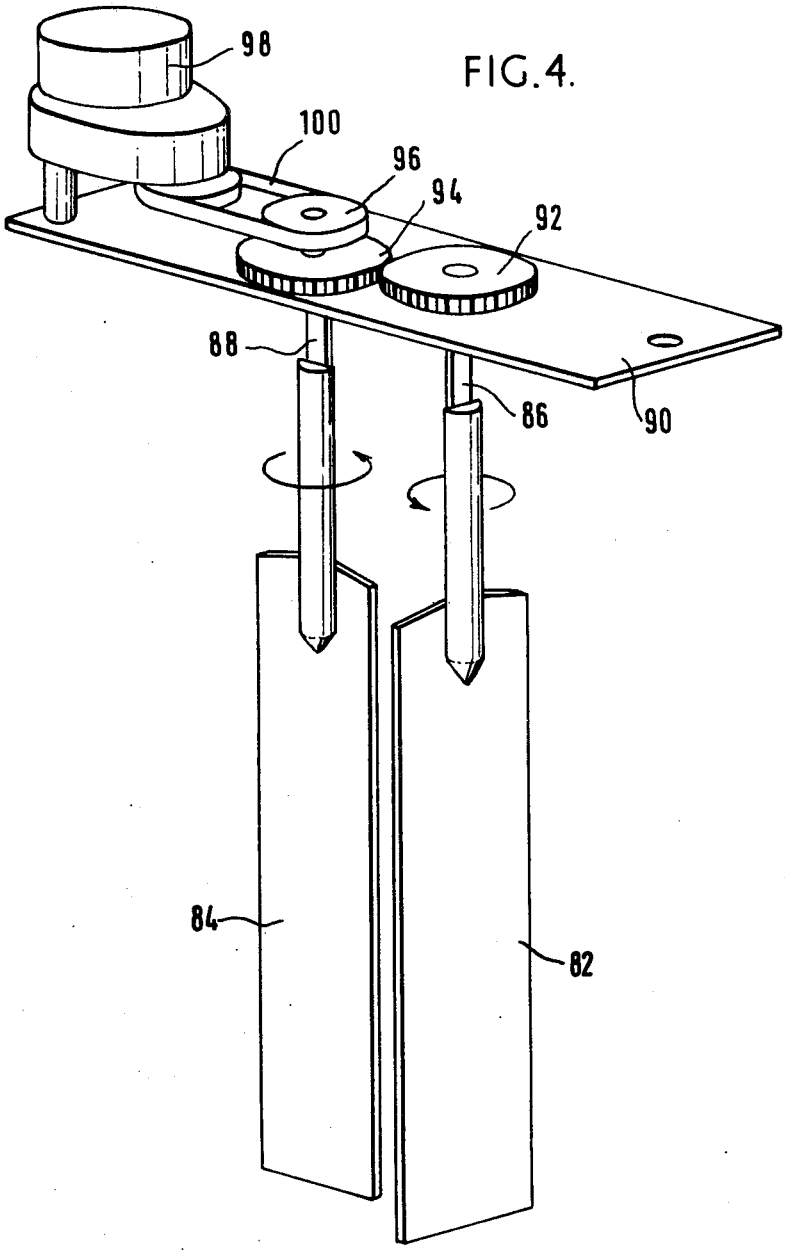
FIG. 4 is a diagrammatic perspective view of a stirrer mechanism of the apparatus of FIG. 1.

In each of the treatment tanks 10, 12, 14, 16 there is also partly immersed a respective stirring mechanism 80*a*, 80*b*, 80*c* and 80*d*. With reference to FIG. 4, we shall describe the stirring mechanism 80*a*.

With reference to FIG. 4, the stirring mechanism 80*a* comprises two elongate lamellar blades 82, 84 carried by parallel shafts 86, 88 rotatably supported by a horizontal plate 90 mounted between opposite side walls of the respective tank so that the shafts, 86, 88 with the blades 82, 84 depend vertically downwards. Two mutually meshing toothed wheels 92, 94 are keyed on the shafts 86, 88, the toothed wheel 94 being operatively connected by means of a belt 100 to a pulley 96 driven by an electric motor 98.

Figure 5:
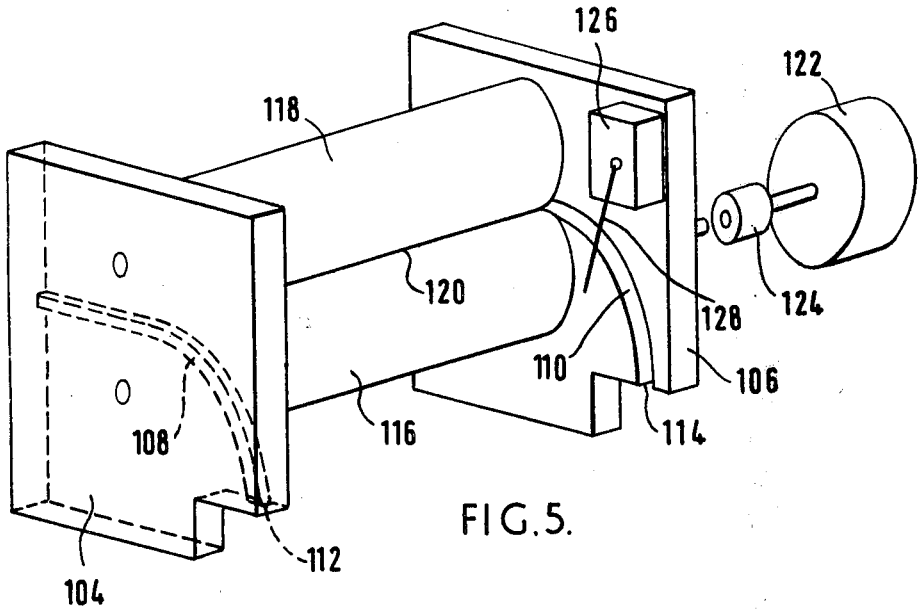
FIG. 5 is a diagrammatic perspective view of an extractor mechanism of the apparatus of FIG. 1.

FIG. 5 shows an extractor mechanism associated with the last dipping group 11*d* and indicated by 102 in FIG. 1.

The extractor mechanism 102, comprises, similarly to the transfer mechanisms 48, two opposite side walls 104, 106 which are connected to the side walls of the dipping mechanism 11*d* so as to have their inner faces at the same level as the inner faces of the dipping mechanism 11*d*. The two inner faces of the side walls 104, 106 are formed with respective guide grooves 108, 110 having the form of a quarter of a circle, the inlet ends 112, 114 of the grooves adjoining to the outlet ends of the guide grooves of the dipping mechanism 11*d*.

Two rubber rollers 116, 118 are rotatably mounted on parallel shafts and in mutual frictional engagement, the contact line 120 between the two rollers lying on the imaginary quarter-cylindrical surface defined by the grooves 108, 110.

One of the squeezing rollers, such as the roller 116, is driven by an electric motor 122 by way of a coupling 124.

One of the side walls of the extracted mechanism carries a micro-switch 126 whose actuating arm 128 interferes with the imaginary quarter-cylindrical surface defined by the guide grooves 108, 110 to detect the arrival of a coupon.

Figure 7:
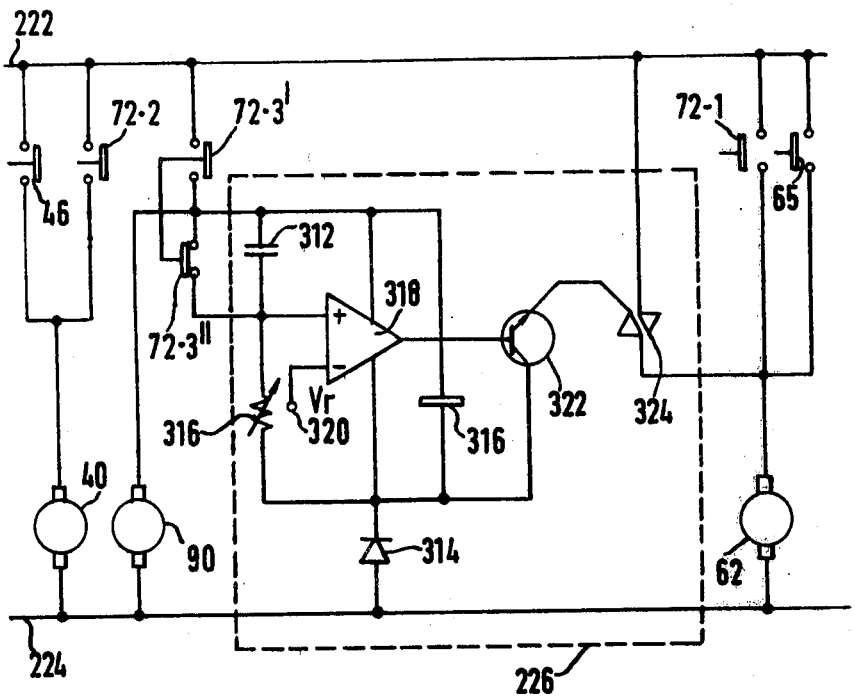
FIG. 7 is a circuit diagram of the electronic control circuit of a dipping mechanism and a preceding transfer mechanism.

FIG. 7 shows a simplified diagram of a control circuit for a typical dipping mechanism 11 together with an immediately preceeding transfer mechanism. In FIG. 7, reference numerals 222 and 224 indicate leads supplying monophase alternating current. The portion 226 indicated by dashed lines is a timing circuit which will be described below, whereas the other components comprise motors and microswitches already illustrated in the preceding Figures and bearing the same reference numerals.

Figure 9:
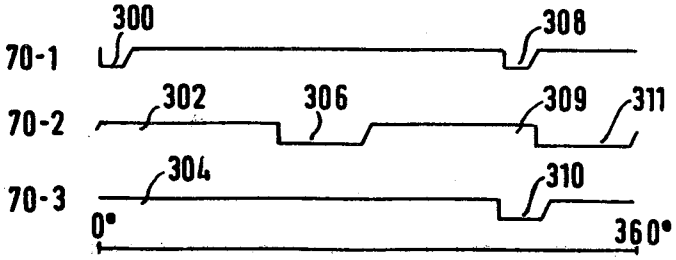
FIG. 9 is a diagram illustrating the shape of some cams in the apparatus.

Assuming that a coupon pushed by a preceding dipping mechanism reaches the inlet of the transfer mechanism in question, it will actuate the microswitch 65, thereby closing the energising circuit of the motor 62 of the transfer mechanism. The motor will start rotating and the coupon will be transferred along the loop groove. The motor will also rotate the cams 70 associated therewith. (See also FIG. 9 which shows the shape of the cams 70). At this initial instant of the cycle, the notch 300 in the cam 70-1 permits the microswitch 72-1 to be kept open, while the normally closed microswitch 72-2 is kept open by the portion 302 of the second cam 70-2. Finally, one of the contacts of the microswitch 70-3 is kept closed and the other open by the portion 304 of the third cam 70-3.

As the motor 62 starts rotating, the self-holding microswitch 72-1 is closed. The coupon is thus moved forward through the transfer mechanism, and during the movement of the coupon, the second cam 70-2 at its notch 306 allows the normally closed microswitch 72-2 to be closed, thereby starting the motor 40 of the dipping mechanism cooperating therewith. This result in the microswitch 46 which was kept open by the tooth 44 of the dipping mechanism being closed, and thus the motor 40 of the dipping mechanism continues to rotate even after the second cam has reopened the microswitch 72-2.

After the coupon has emerged from the transfer mechanism and has reached the inlet of the successive dipping mechanism, the first cam allows the contact 72-1 to be reopened owing to the notch 308. Almost simultaneously, the notch 310 of the third cam 70-3 releases the microswitch 72-3 which thus closes one of its contacts 72-3' to energize the motor 90 of the stirring mechanism and to feed the timer 226, and opens the contact 72-3" in parallel with the capacitor 312.

As shown in FIG. 7, the timing circuit 226 is supplied via the diode 314 which rectifies the alternating current on the lines 222, 224 and has a filter capacitor 316 in parallel therewith. Upon opening of the contact 72-3", the capacitor 312 starts to become charged by way of the resistor 316, and the voltage across it is applied to one of the inputs of a differential amplifier 318 the other input of which is connected to the reference voltage 320. When voltage across the ends of the capacitor 312 exceeds the reference voltage, the output of the differential amplifier 318 enables a transistor 322 thereby striking a triac 324 in parallel with the microswitches 65 and 72-1 and starting the motor 62 of the transfer group so that the latter completes its cycle and returns to the starting position at the beginning of the cycle with the first cam 70-1 positioned with its notch 300 at the microswitch 72-1.

Meanwhile, the motor 40 of the dipping mechanism has been stopped again by the tooth 45 which has acted upon the microswitch 46 (the microswitch 72-2 is open since the portion 309 of the second cam 70-2 keeps it in that position). In these conditions, the dipping mechanism is stationary to keep the coupon in front of the stirrer which is kept in operation while all the other mechanisms are stationary for the time required by the capacitor 312 to be charged. When the motor 72 of the transfer mechanism is started again by the triac 324, the notch 311 of the second cam causes the contact 72-2 to be closed, thereby restarting the motor 40 of the dipping mechanism to bring it back to the beginning of the cycle, and moving the coupon to the inlet of the successive transfer mechanism. Also the microswitch 72-3 is brought to the starting conditions by the third cam, while the motor 90 of the stirrer is stopped, the entire timing circuit 226 is deenergized, and the capacitor 312 is shortcircuited.

Since each group of a transfer mechanism and the successive dipping mechanism is provided with a circuit similar to that just described, clearly the arrival of a coupon at the successive transfer mechanism starts a procedure identical to that described above. The treatment time for each coupon in each bath is adjustable in an independent manner by varying the resistance of the resistor 314 and thus the charge time constant.

FIG. 8 diagrammatically illustrates the entire control circuit of the apparatus, the same reference numerals being used as in FIG. 7 with the addition of the suffices a, b, c, d. Moreover, FIG. 8 shows the motor 214 which drives the drive belt of the introducer mechanism 47. The motor 214 is started upon closing of the coupon detecting microswitch 216, and is kept energized by the normally closed microswitch 218 when the tooth 212 allows the contact to be closed at the start of the motor 214. It should be noted that the microswitch 65*a* (see also FIG. 1) which is closed by the tooth 210 when the coupon reaches the inlet of the first dipping mechanism, substitutes in this case the microswitch normally provided at the inlet of each transfer mechanism to restart the motor 62*a*. This motor which is equivalent to each of the motors of the transfer mechanism is, however, a dummy transfer element and has the only function of driving the cams 70*a*.

At the outlet of the last dipping mechanism, the coupon closes the microswitch 126 which energizes a monostable timing device 127 to energize and keep energized for a predetermined time the motor 122 driving the extracting rollers so that the coupon is completely moved out of the rollers and the rollers then rotate idly to be dried.

The above described machine operates as follows.

Once a photosensitive paper coupon 13 has been exposed in a conventional automatic camera (not shown in the drawings) as described in previous patents, the coupon is conveyed to the inlet of the guide grooves 24, 26 of the first dipping mechanism 11*a* by means of the introducer mechanism 47. After the coupon has entered the grooves as the contact 72-2*a* has been closed by its respective cam of the dummy motor 62*a* the drive belt for the dipping mechanism 11*a* is driven. The transport tooth 38 on the belt then engages the trailing edge of the coupon 13, thereby pushing it downwards into the tank in order to immerse it in the first treatment bath which usually comprises a developing bath. The coupon then moves past the lowest point in the loop of the dipping mechanism and is raised to the position illustrated in FIG. 1. At this point, owing to actuation of the microswitch 46, the motor 40 stops while the coupon is in front of the stirrer for a time interval dictated by the timer 226*a*.

After the predetermined dwelling time, the motor 40 is started again and the transport tooth 38 pushes the coupon upwards until the latter enters the grooves of the transfer mechanism 48*a* also in cooperation with the arch-like shoe 74. The transport tooth 38 while passing around the pulley 32 disengages itself from the coupon 13 which is then engaged by the teeth 66, 68 carried by the wheels 56, 58 of the transfer mechanism 48*a*. Such teeth convey the coupon to the inlet of the grooves of the second dipping mechanism 11*b*. The arrival of the coupon is detected by a microswitch which also starts the operation cycle of the dipping mechanism 11*b* in a manner similar to that of the operation of the dipping mechanism 11*a*, thereby conveying the coupon to the region in front of the stirring mechanism 80*b* in the tank 12, keeping the coupon stationary in that position for a predetermined time controlled by a respective timing device, keeping the stirring mechanism 80*b* running during the stay time of the coupon, and then conveying the coupon to the outlet of the second dipping mechanism 11*b* ready to be transferred to the second transfer mechanism 48*b*.

The same operations are then carried out in the dipping mechanisms 11*c* and 11*d* and in the transfer mechanism 48*c*. In any case, starting and stopping of each motor (for the dipping mechanism, and transfer mechanisms and that stirring mechanisms) are controlled by the various microswitches by way of the above-described control circuits.

At the outlet of the fourth dipping mechanism 11*d*, the coupon, instead of being withdrawn by a further transfer mechanism, is pushed by the transport tooth of the dipping mechanism 11*d* directly between the squeezing rollers 116, 118 which squeeze out the liquid of the last treatment bath (usually the washing bath), thereby delivering the coupon substantially dried and ready for collection.

It will be noted that with the photographic treatment installation described above no liquid, not even in small amounts, is transferred from one treatment tank to another apart from that due to the coupon itself. Each of the various members which move the coupon forward acts either completely outside the baths (as in the case of the transfer mechanisms) or always in connection with a single treatment bath (as in the cases of dipping mechanisms and the stirring mechanisms). Consequently, mutual pollution between baths, which would result in deterioration of the bath, is reduced to a minimum compatible with the performance of the function of the baths.

Interdependence between the working cycles of each of the dipping mechanisms of the stirring groups makes it possible to treat a plurality of coupons in rapid succession, i.e. it makes it possible to treat a different coupon simultaneously in each treatment tank, although the dwelling time of the coupons in the various baths can be chosen at will. It is sufficient to allow insertion of the various successive coupons in the first tank at intervals not shorter than the longest dwelling time required for the various tanks. Moreover, the dwelling time can be adjusted in a simple way even while the machine is in operation by simply regulating a timing device. This makes possible easy setting up of the installation on the basis of the observed treatment results, or depending upon predetermined ageing times of the baths.

Although the arrangement described with reference to and illustrated in FIGS. 1 to 5 operates satisfactorily with sheets having relatively small dimensions such as in the case of standard indentification cards, it has been found that with sheets having larger dimensions the sheet, while passing from the straight length of the grooves to the semicirculation length thereof, does not easily adapt itself to the bending caused by the bend configuration of the grooves and disengages itself from the grooves and gets lost on the bottom of the vessel, and thus it eludes further automatic treatment. This may happen in particular when the sheet is originally slightly concave in the direction opposite to that towards which it must bend.

Figure 6:
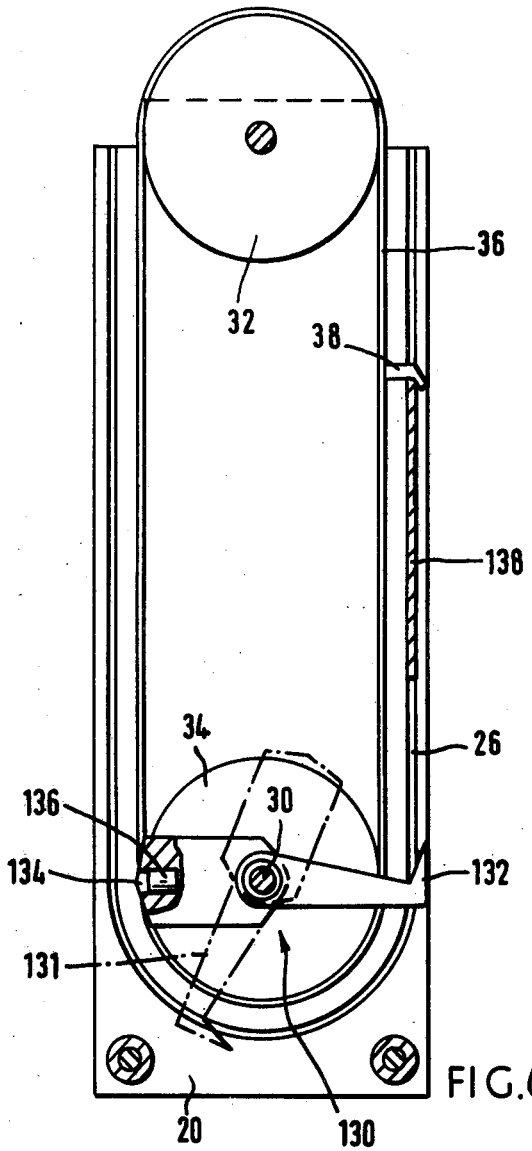
FIG. 6 is a diagrammatic view of a modification to the dipping mechanism of the apparatus of FIG. 1.

The modification illustrated in FIG. 6 aims to avoid the above mentioned disadvantage by providing auxiliary engaging means designed to prevent the sheet from leaving the guide grooves while passing from the straight to the semicircular section of the grooves, while permitting the sheet to proceed without being held once the end of the circular bend has been reached, where the grooves are straight again.

With reference to FIG. 6, while adopting the same reference numerals as in FIGS. 1 to 5 for indicating similar parts, it will be noted that the engaging means in FIG. 6 comprises a rocking arm generally indicated by 130 and carrying at one end thereof a tooth 132 having an inner oblique surface which interferes with the ideal surface defined by the groove 26 together with the corresponding opposite groove, not shown in FIG. 6.

The rocking arm 130 is freely rotatably mounted on a shaft 30 which also carries a lower pulley 34 for the drive belt 36. The shaft 30, as described with reference to FIGS. 1 to 5, extends through the centers of curvature of the semicircular bends defined by the guide groove 26 and the groove associated therewith, not visible in FIG. 6.

The end of the rocking arm opposite to the tooth 132 has a sheet 134 for a counterweight 136 which is adapted to keep the rocking arm 130 in the position illustrated by solid lines in the drawing, in which position the tooth 132 is located approximately at the beginning of the semicircular bend of the groove 26 to be touched by a sheet 138 before the leading edge of the sheet has started negotiating the bend trajectory defined by the groove.

Preferably, the two opposite parts of the rocking arm 130 comprising the tooth 132 and the counterweight 136, respectively, can be adjusted in their angular position one with respect to the other so as to position the tooth 132 in an optimum free position.

When a sheet 138 pushed by the tooth 38 moves forwards against the tooth 132, the rocking arm 130 is caused to rotate clockwise when observing the drawing, whereas the oblique surface of the tooth 132 prevents the sheet 138 from coming out of its guides. The rocking arm 130 continues to rotate under the action of the leading edge of the sheet 138 and against the action of the counterweight 136 until it reaches approximately the position 131 illustrated by dashed lines in the drawing. At this point, the counterweight 136 prevails and accelerates the rocking arm 130 in rotation, which results in the tooth 132 freeing the leading edge of the sheet (which is now safe from possible derailments), thereby bringing the rocking arm 130 back to the position illustrated by solid lines, after which the rocking arm has then completed a full rotation.

Once a sheet 138 has reached the beginning of the outlet straight length of the guide grooves, there is no longer risk of derailment and the sheet can continue its movement upwards for it is now disengaged from the tooth 102 of the rocking arm.

I claim:

1. Apparatus for automatically treating pieces of exposed photosensitive paper, comprising at least three tanks each of which is adapted to contain a respective treatment bath; at least three dipping mechanisms sequentially actuated, each associated with a respective one of the tanks for sequentially dipping one at a time of said pieces of paper into the respective bath, each dipping mechanism comprising a respective slide guide having an inlet end and an outlet end and an intermediate zone arranged so that, in use, the inlet and outlet ends are external to the bath while the intermediate zone is immersed in the bath, the slide guide being adapted for the piece of paper to slide in the slide guide, each dipping mechanism further comprising a respective conveying mechanism with a respective travelling member adapted to engage the piece of paper in the respective slide guide and to move the piece of paper the entire length along the respective slide guide from the inlet end along the intermediate zone to the outlet end thereof, said travelling member remaining in continuous contact with said photosensitive paper and automatically disengaging from the piece of paper at the outlet end; at least two transfer mechanisms, each arranged between a respective pair of said dipping mechanisms and each comprising a respective slide guide adapted for the piece of paper to slide therein and extending from the outlet end of the slide guide of one dipping mechanism of the said pair to the inlet end of the slide guide of the other dipping mechanism of the said pair, each of said transfer mechanisms comprising a respective conveying mechanism including at least one respective travelling member adapted to engage the piece of paper in the respective slide guide and to move the piece of paper along the slide guide; control means adapted to stop said photosensitive piece of paper at a stop position in each dipping mechanism for a period of time while the piece of paper is immersed in the respective bath; and means for introducing said exposed photosensitive paper to said respective treatment bath of one of said at least three tanks, said introducer means comprising a guiding means having an inlet at one end and an outlet at an opposite end, said guiding means being adapted for the piece of paper to slide therein, said introducer means further comprising a transferring mechanism with a moving member adapted to engage the piece of paper and to move the piece of paper the entire length along said guiding means from said inlet at one end to said outlet at said opposite end, said moving member remaining in continuous contact with said photosensitive paper and automatically disengaging from the piece of paper at said opposite end, said outlet being adapted to cooperate with said inlet end of said dipping mechanism associated with said one of said at least three tanks.

2. Apparatus as defined in claim 1 and further comprising an extractor mechanism associated with the outlet end of the slide guide of the last dipping mechanism, and comprising two squeezing rollers on a respective slide guide adjoining the outlet end of the slide guide of the last dipping mechanism and terminating at the gap between said two squeezing rollers.

3. Apparatus as defined in claim 1 wherein there is provided in each tank a respective stirring mechanism adapted to stir the bath in a zone close to the stop position of the coupon in the bath.

4. Apparatus as defined in claim 1 wherein the slide guides of the dipping mechanisms, the transfer mechanisms and the extractor mechanism are in the form of grooves formed in respective parallel side walls facing each other, the distance between the bottoms of the grooves being approximately equal to the width of the piece of paper.

5. Apparatus as defined in claim 4, wherein the guide grooves of each dipping mechanism comprises two parallel vertical lengths adjoining a semicircular loop at their lower ends.

6. Apparatus as defined in claim 5, wherein each conveying mechanism in each dipping mechanism comprises a belt driven by means of pulleys and disposed parallel to the grooves in an intermediate position between the said side walls, the belt being slightly internal to an imaginary surface defined by the grooves and bearing a pushing tooth designed to push the piece of paper forwards and to project outwards to a point where it interferes with the said imaginary surface, at least one of the pulleys being motor driven.

7. Apparatus as defined in claim 5, wherein the grooves forming the slide guide of each transfer mechanism are in the form of semicircular loops and the conveying mechanism of each transfer mechanism comprises at least one wheel driven by a motor and mounted parallel to the said guide walls, the wheel having a diameter slightly smaller than that of the said semicircular loop and having a tooth which projects outwards to interfere with an imaginary semi-circular surface defined by the two grooves.

8. Apparatus as defined in claim 3 wherein said stirring mechanism comprises two elongate blades which can rotate about their longitudinal axes and are vertically immersed in the respective tanks, and motor means adapted and arranged to rotate said blades.

9. Apparatus as defined in claim 1 wherein the said control means comprises a timer which is adjustable so as to make it possible to vary the stop time of each dipping mechanism.

10. Apparatus for automatically treating pieces of exposed photosensitive paper, comprising at least three tanks each of which is adapted to contain a respective treatment bath; at least three dipping mechanisms sequentially actuated, each associated with a respective one of the tanks for dipping one at a time of said pieces of paper into the respective bath, each dipping mechanism comprising a respective slide guide having an inlet end and an outlet end and an intermediate zone arranged so that, in use, the inlet and outlet ends are external to the bath while the intermediate zone is immersed in the bath, the slide guide being adapted for the piece of paper to slide in the slide guide, each dipping mechanism further comprising a respective conveying mechanism with a respective travelling member adapted to engage the piece of paper in the respective slide guide and to move the piece of paper the entire length along the respective slide guide from the inlet end along the intermediate zone to the outlet end thereof, said travelling member remaining in continuous contact with said photosensitive paper and automatically disengaging from the piece of paper at the outlet end; at least two transfer mechanisms, each arranged between a respective pair of said dipping mechanisms and each comprising a respective slide guide adapted for the piece of paper to slide therein and extending from the outlet end of the slide guide of one dipping mechanism of the said pair to the inlet end of the slide guide of the other dipping mechanism of the said pair, each of said transfer mechanisms comprising a respective conveying mechanism including at least one respective travelling member adapted to engage the piece of paper in the respective slide guide and to move the piece of paper along the slide guide; control means adapted to stop said photosensitive piece of paper at a stop position in each dipping mechanism for a period of time while the piece of paper is immersed in the respective bath;

means for stirring said treatment bath, said stirring means adapted to stir the bath in a zone in close proximity to the stop position of the piece of photosensitive paper in the bath, said stirring means having at least one vertically lamellar blade extending into the respective bath;

means for introducing said exposed photosensitive paper to said respective treatment bath of one of said at least three tanks, said introducer means comprising a guiding means having an inlet at one end and an outlet at an opposite end, said guiding means being adapted for the piece of paper to slide therein, said introducer means further comprising a transferring mechanism with a moving member adapted to engage the piece of paper and to move the piece of paper the entire length along said guiding means from said inlet at one end to said outlet at said opposite end, said moving member remaining in continuous contact with said photosensitive paper and automatically disengaging from the piece of paper at said opposite end, said outlet being adapted to cooperate with said inlet end of said dipping mechanism associated with said one of said at least three tanks;

and further comprising an extractor mechanism associated with the outlet end of the slide guide of the last dipping mechanism, and comprising a respective slide guide adjoining the outlet end of the slide guide of the last dipping mechanism and terminating at the gap between two squeezing rollers;

wherein the slide guides of the dipping mechanisms, the transfer mechanisms and the extractor mechanism are in the form of grooves formed in respective parallel side walls facing each other, the distance between the bottoms of the grooves being approximately equal to the width of the piece of paper;

wherein the guide grooves of each dipping mechanism comprises two parallel vertical lengths adjoining a semicircular loop at their lower ends;

wherein each conveying mechanism in each dipping mechanism comprises a belt driven by means of pulleys and disposed parallel to the grooves in an intermediate position between the said side walls, the belt being slightly internal to an imaginary surface defined by the grooves and bearing a pushing tooth designed to push the piece of paper forwards and to project outwards to a point where it interferes with the said imaginary surface, at least one of the pulleys being motor driven;

wherein the grooves forming the slide guide of each transfer mechanism are in the form of semicircular loops and the conveying mechanism of each transfer mechanism comprises at least one wheel driven by a motor and mounted parallel to the said guide walls, the wheel having a diameter slightly smaller than that of the said semicircular loop and having a tooth which projects outwards to interfere with an imaginary semi-circular surface defined by the two grooves;

wherein said means for stirring comprises two elongate blades which can rotate about their longitudinal axes and are vertically immersed in the respective tank, and motor means adapted and arranged to rotate the said blades; and wherein the said control means comprises a timer which is adjustable so as to make it possible to vary the stop time of each dipping mechanism.

11. The invention as defined in claim 1 wherein said control means comprises:

switch means responsive to the entry of a piece of paper from said transfer mechanisms;

timing means responsive to the activation of said switch means, said timing means having an output and being operable upon activation from said switch means for producing a signal to its output for a predetermined period of time; and motor means responsive to said output from said timing means, for moving the piece of paper through said transfer mechanisms.

12. The invention as defined in claim 11 wherein said timing means further comprises:

a differential amplifier having a first and second input and an output;

a capacitor connected to one of said differential inputs;

means for charging said capacitor upon activation of said switch means;

means connected to said differential amplifier output for activiting said motor means for said predetermined period of time upon deactivation of said switch means, said predetermined period of time being dependent upon the value of the capacitor.

13. The invention as defined in claim 12 wherein said means connected to said differential amplifier output further comprises an electronic switch means.

14. The invention as defined in claim 13 wherein said electronic switch means further comprises a transistor having an input connected to said differential amplifier output, said transistor having an output connected to an input of a triac, said triac being connected in series with said motor means.

* * * * *

UNITED STATES PATENT AND TRADEMARK OFFICE

CERTIFICATE OF CORRECTION

PATENT NO. : 4,156,569

DATED : May 29, 1979

INVENTOR(S) : Osvaldo Fasano

It is certified that error appears in the above-identified patent and that said Letters Patent are hereby corrected as shown below:

Column 3, line 60, delete the numeral "215" and insert the numeral ----216----.

Column 9, line 16, delete the numeral "102" and insert the numeral ----132----.

Column 10, line 51, delete the word "tanks" and insert the word ----tank----.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*